US009196969B2

(12) United States Patent
Wu et al.

(10) Patent No.: US 9,196,969 B2
(45) Date of Patent: Nov. 24, 2015

(54) RADIATING ELEMENT FOR ANTENNA

(75) Inventors: Zhonglin Wu, Guangdong (CN); Lei Shi, Guangdong (CN); Gang Cheng, Guangdong (CN); Mulin Liu, Guangdong (CN); Zhuofeng Gao, Guangdong (CN)

(73) Assignee: TONGYU COMMUNICATION, INC., Zhongshan, Guangdong (CN)

( * ) Notice: Subject to any disclaimer, the term of this patent is extended or adjusted under 35 U.S.C. 154(b) by 176 days.

(21) Appl. No.: 13/419,140

(22) Filed: Mar. 13, 2012

(65) Prior Publication Data

US 2012/0235873 A1 Sep. 20, 2012

(30) Foreign Application Priority Data

Mar. 17, 2011 (CN) ..... 2011 1 0064693

(51) Int. Cl.

| | |
|---|---|
| ***H01Q 21/26*** | (2006.01) |
| ***H01Q 19/10*** | (2006.01) |
| ***H01Q 1/24*** | (2006.01) |
| ***H01Q 9/28*** | (2006.01) |

(52) U.S. Cl.

CPC ..... *H01Q 21/26* (2013.01); *H01Q 1/246* (2013.01); *H01Q 9/285* (2013.01); *H01Q 19/10* (2013.01)

(58) Field of Classification Search

CPC ..... H01Q 21/24; H01Q 21/26; H01Q 19/10; H01Q 9/285

USPC ..... 343/793, 795, 797, 799, 801, 815, 818, 343/819, 834

See application file for complete search history.

(56) References Cited

U.S. PATENT DOCUMENTS

| | | | | |
|---|---|---|---|---|
| 3,952,310 | A * | 4/1976 | Griffee et al. | 343/730 |
| 6,597,324 | B2 * | 7/2003 | Eriksson | 343/795 |
| 6,933,906 | B2 * | 8/2005 | Stolle et al. | 343/797 |
| 6,940,465 | B2 * | 9/2005 | Gottl et al. | 343/797 |
| 2003/0090431 | A1 | 5/2003 | Gottl | |
| 2005/0134517 | A1 * | 6/2005 | Gottl | 343/797 |
| 2008/0036674 | A1 * | 2/2008 | Riedel et al. | 343/818 |
| 2012/0098725 | A1 * | 4/2012 | Lytle et al. | 343/797 |

FOREIGN PATENT DOCUMENTS

| | | |
|---|---|---|
| CN | 1303528 | 7/2001 |
| CN | 2676432 | 2/2005 |
| CN | 101425626 | 5/2009 |
| CN | 101789143 | 7/2010 |

(Continued)

*Primary Examiner* — Robert Karacsony
*Assistant Examiner* — Daniel J Munoz
(74) *Attorney, Agent, or Firm* — Finnegan, Henderson, Farabow, Garrett & Dunner LLP

(57) ABSTRACT

A radiating element includes a supporting element and a plurality of radiating units formed at one end of the supporting element. Each of the radiating units has a lower surface facing towards the supporting element and an upper surface facing away from the supporting element. The radiating element further includes a first and second dividing pieces symmetrically disposed on each of the radiating units. The radiating element also includes a loading element formed on the lower surface of each of the plurality of radiating units, wherein the loading element extends outward from the supporting element and along an edge of the radiating unit. Moreover, the radiating element includes an electrical connecting element for connecting the radiating units to a feeding cable, the electrical connecting element being lower than the upper surfaces of the radiating units.

13 Claims, 7 Drawing Sheets

(56) References Cited

FOREIGN PATENT DOCUMENTS

| | | |
|---|---|---|
| CN | 201576744 | 9/2010 |
| CN | 102025019 | 4/2011 |
| CN | 102117967 | 7/2011 |
| CN | 102176536 | 9/2011 |

* cited by examiner

RADIATING ELEMENT FOR ANTENNA

CROSS-REFERENCE TO RELATED APPLICATION

This application claims the benefit of priority to Chinese Patent Application No. 201110064693.7, filed on Mar. 17, 2011, the contents of which are incorporated herein by reference in their entirety.

TECHNICAL FIELD

The present disclosure relates to a base station antenna for use in mobile communication system. More particularly, the present disclosure relates to a radiating element for an antenna comprising the same.

BACKGROUND

With the fast development of mobile communication, various communication standards and operating frequency ranges thereof are proposed and utilized. For example, a TD-SCDMA ("Time Division Synchronous Code Division Multiple Access") system operates at a frequency range from 1880 to 1920 MHz, from 2010 to 2025 MHz, and from 2300 to 2400 MHz; a DCS ("Digital Cellular Service") system operates at a frequency range from 1710 to 1880 MHz; a PCS ("Personal Communications Service") system operates at a frequency range from 1850 to 1990 MHz; a UMTS ("Universal Mobile Telecommunication System") system operates at a frequency range from 1920 to 2170 MHz; and some sections of WiMax (Worldwide Interoperability for Microwave Access) operate at a range from 2300 to 2690 MHz. Accordingly, it may be desirable to have a wideband antenna that covers a frequency range from about 1710 to about 2690 MHz, with a suitable relative bandwidth.

Chinese Patent Application No. 20091003979.4 discloses a dual-polarized antenna radiating element that utilizes four fan-shaped hollowed radiating slices. However, its relative bandwidth is not satisfactory to the requirements of wideband wireless communication.

SUMMARY

In accordance with an embodiment, there is provided a radiating element comprising a supporting element and a plurality of radiating units formed at one end of the supporting element. Each of the radiating units has a lower surface facing towards the supporting element and an upper surface facing away from the supporting element. The radiating element further comprises a first and second dividing pieces symmetrically disposed on each of the radiating units, wherein the first dividing piece and a first portion of edges of the radiating unit form a first polygonal hollowed space; the second dividing piece and a second portion of edges of the radiating unit form a second polygonal hollowed space; the first and second dividing pieces and a third portion of edges of the radiating unit form a third polygonal hollowed space; wherein the first and second polygonal hollowed spaces are symmetrical with respect to the third polygonal hollowed space. The radiating element also comprises a loading element formed on the lower surface of each of the plurality of radiating units, wherein the loading element extends outward from the supporting element and along an edge of the radiating unit. Moreover, the radiating element comprises an electrical connecting element for connecting the radiating units to a feeding cable, the electrical connecting element being lower than the upper surfaces of the radiating units.

Another embodiment involves an antenna comprising a reflector and the radiating element discussed above.

The preceding summary and the following detailed description are exemplary only and do not limit of the scope of the claims.

BRIEF DESCRIPTION OF THE DRAWINGS

The accompanying drawings, which are incorporated in and constitute a part of this specification, in connection with the description, illustrate various embodiments and exemplary aspects of the disclosed embodiments. In the drawings.

DESCRIPTION OF EXEMPLARY EMBODIMENTS

Reference will now be made in detail to exemplary embodiments, examples of which are illustrated in the accompanying drawings. When appropriate, the same reference numbers are used throughout the drawings to refer to the same or like parts.

Figure 1:
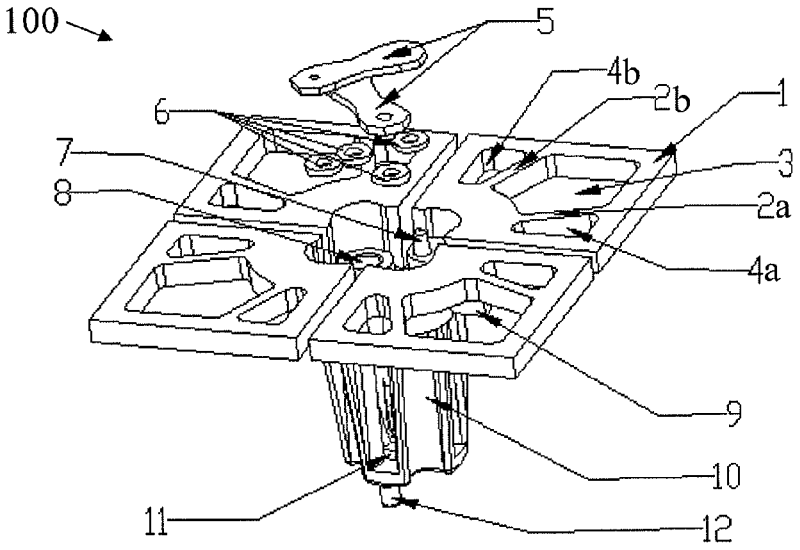
FIG. 1 is a partially disassembled view of an exemplary radiating element consistent with some disclosed embodiments.
Figure 3:
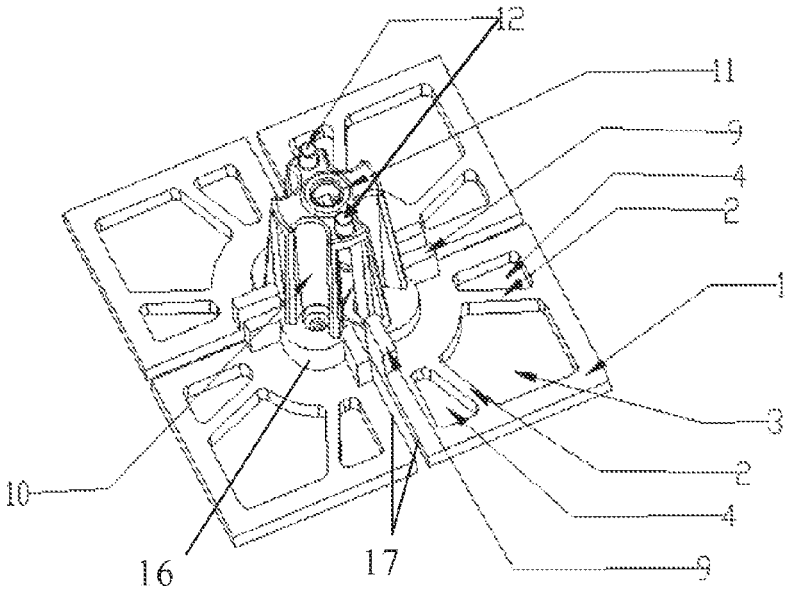
FIG. 3 is another perspective view from a different angle of the exemplary radiating element shown in FIG. 2.
Figure 10:
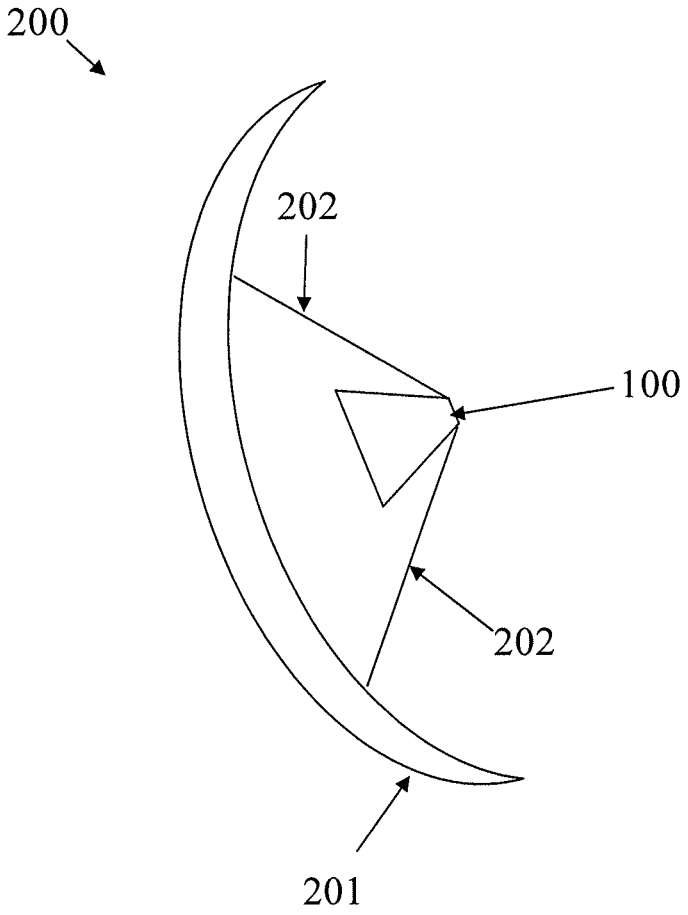
FIG. 10 is a schematic diagram of an antenna including an exemplary radiating element, in accordance with some disclosed embodiments.

Embodiments of the present disclosure involve a radiating element that provides dual-polarized directional radiation and an antenna comprising the same. FIG. 1 shows a partially disassembled view of an exemplary radiating element 100 consistent with some disclosed embodiments. Referring to FIG. 1, radiating element 100 may assume generally a three-dimensional "T" shape. Radiating element 100 includes a supporting element 10 to support a plurality of radiating units 1. The plurality of radiating units 1 are formed at one end of supporting element 10. Radiating units 1 are discussed in greater details below. Radiating element 100 may be mounted on a reflector, such as reflector 201 in FIG. 10, to form an antenna (e.g., antenna 200 in FIG. 10) using, for example, an aligning pin 12 and a screw hole 11. In some embodiments, aligning pin 12 and screw hole 11 may be located at another end of supporting element 10 that is opposite to the one forming radiating units 1. In some embodiments, there may be more than one aligning pin. For example, FIG. 3 shows an embodiment that includes two aligning pins 12, wherein screw hole 11 is located between the two aligning pins 12. Referring to FIG. 10, reflector 201 may include positioning hole(s) or recess portion(s) that matches the aligning pin(s) 12. Reflector 201 may also include a bolt that engages screw hole 11 to firmly mount radiating element 100 onto reflector 201 to form antenna 200.

Referring again to FIG. 1, each of radiating units 1 has a lower surface that faces towards supporting element 10 (e.g., the surface facing "downward" in FIG. 1) and an upper surface that faces away from supporting element 10 (e.g., the surface facing "upward" in FIG. 1). However, it is noted that the words "lower" and "upper" are merely used to distinguish the two surfaces of radiating unit 1 with respect to supporting element 10, and are not intended to limit the actual directions these surfaces face during operation.

Radiating unit 1 may have a hollowed configuration and comprise first (2*a*) and second (2*b*) dividing pieces symmetrically disposed. First and second dividing pieces 2*a* and 2*b* divide the hollowed portion of the radiating unit 1 into three hollowed parts. For example, first dividing piece 2*a* and a lower right corner (e.g., the portion of edges) of radiating unit 1 may form a first polygonal hollowed space 4*a*. Similarly, second dividing piece 2*b* and an upper left corner (e.g., the portion of edges) of radiating unit 1 may form a second polygonal hollowed space 4*b*. In addition, first and second dividing pieces 2*a* and 2*b*, together with the upper right corner and lower left corner, e.g., those portions of edges, of radiating unit 1 may form a third polygonal hollowed space 3. First (4*a*) and second (4*b*) polygonal hollowed spaces may be configured to be symmetrical with respect to third polygonal hollowed space 3. The hollowed configuration may improve impedance performance, bandwidth, and isolation.

Radiating element 100 may also include a loading element formed on the lower surface of each of radiating units 1. For example, FIGS. 1 and 3 illustrate an exemplary loading element 9. Loading element 9 may be formed along an edge of radiating unit 1 and extend outwards from supporting element 10. In some embodiments, loading element 9 may have the same height in the extending direction. As used herein, the term "extending direction" refers to a direction in which loading element 9 extends from supporting element 10 towards an outer edge of radiating unit 1. Therefore, in the embodiment shown in FIG. 3, loading element 9 has a rectangular-shaped cross-section along the extending direction. In FIG. 3, loading element 9 is shown to be shorter than the edge along which it extends. However, in other embodiments, loading element 9 may be longer in the extending direction or extend as far as the outer edge of radiating element 1.

Figure 4:
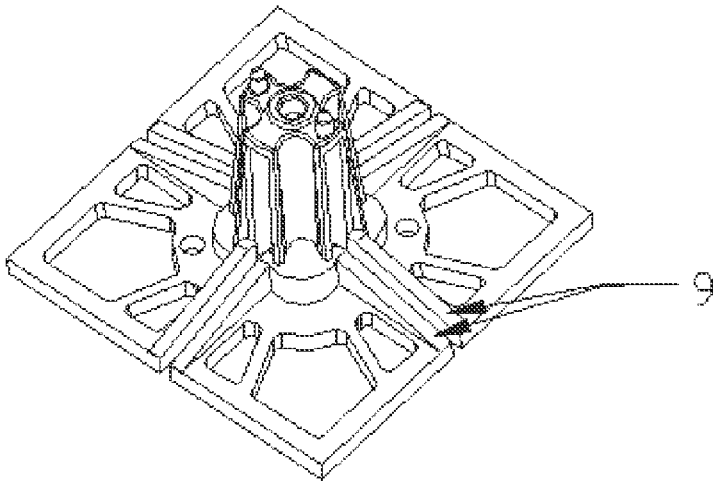
FIG. 4 is a perspective view of an exemplary radiating element in accordance with another disclosed embodiment.

FIG. 4 shows another embodiment in which loading element 9 tapers off along the extending direction from the beginning of extension such that a top surface of loading element 9 is rectangular. In this case, the cross-section is triangular-shaped along the extending direction.

Figure 5:
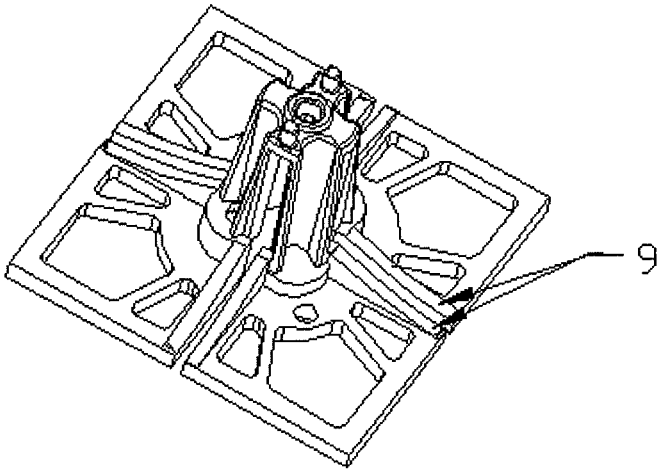
FIG. 5 is a perspective view of an exemplary radiating element in accordance with yet another disclosed embodiment.

FIG. 5 shows yet another embodiment similar to the one shown in FIG. 4. In FIG. 5, loading element 9 has a top surface that is approximately an arc slope, rather than a rectangle as shown in FIG. 4. Therefore, the cross-section of loading element 9 in FIG. 5 along the extending direction is approximately triangular-shaped.

Figure 6:
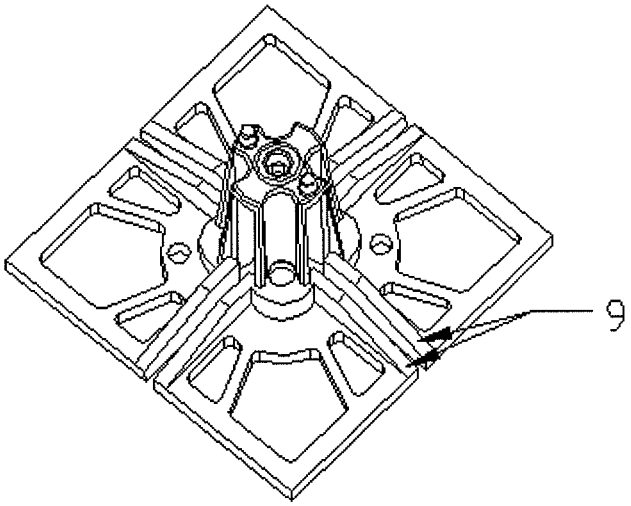
FIG. 6 is a perspective view of an exemplary radiating element in accordance with yet another disclosed embodiment.

FIG. 6 illustrates yet another embodiment. In FIG. 6, loading element 9 tapers off from a middle section to forms a trapezoidal-shaped cross-section along the extending direction.

Figure 2:
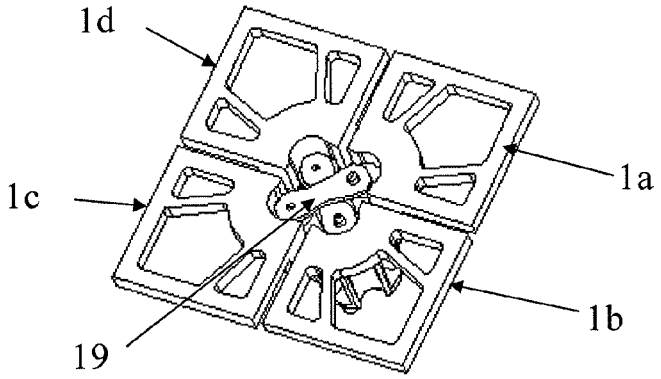
FIG. 2 is a perspective view of an exemplary radiating element consistent with some disclosed embodiments.

Radiating element 100 may comprise a plurality of radiating units. For example, FIG. 2 shows an embodiment that includes four radiating units 1*a*-1*d*. Each radiating unit may be substantially square-shaped, with a depressed portion at an inner corner. The four depressed portions of radiating units 1*a*-1*d* form an opening in a center portion of radiating element 100 having a two-by-two matrix configuration. The plurality of radiating units may have substantially equal height. As used herein, the "height" of a radiating unit refers to the height in a direction perpendicular to the upper and lower surface. The plurality of radiating units may be substantially equally spaced. For example, referring to FIG. 3, a spacing 17 between two adjacent radiating units may be substantially the same for all four radiating units.

Referring again to FIG. 2, the four radiating units 1*a*-1*d* are arranged symmetrically in a two-by-two matrix configuration. Each two diagonally arranged radiating units form a half-wave dipole. For example, radiating units 1*a* and 1*c* form a half-wave dipole. Similarly, radiating units 1*b* and 1*d* form another half-wave dipole. The two dipoles may be orthogonally arranged, as shown in FIG. 2. The directions of electrical currents flowing into each radiating unit of a dipole may have a 180-degree phase difference. Due to vector superposition and cancellation effects, the orthogonally arranged dipoles generate radiation with ±45 degrees polarization. Such dual-polarization may provide directional radiation with high isolation properties. In addition, the above-discussed configuration may improve impedance performance and broaden bandwidth.

Figure 7:
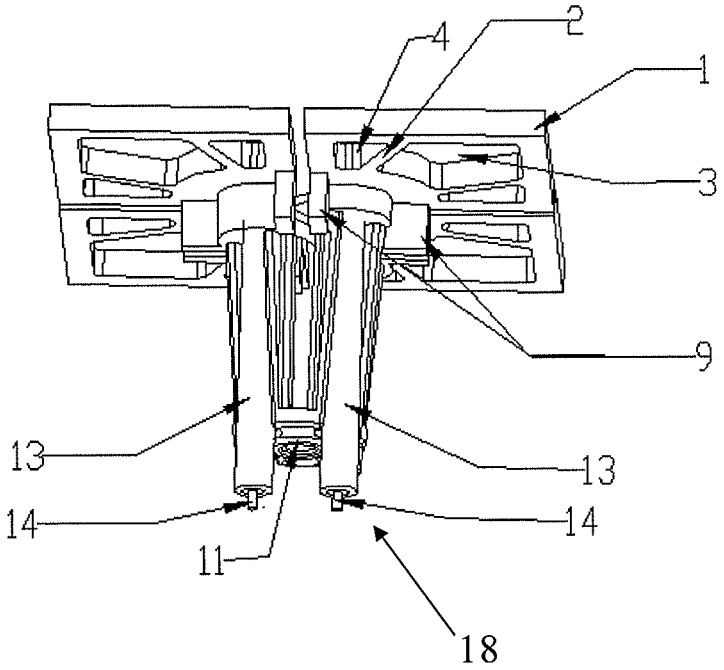
FIG. 7 is a perspective view of an exemplary radiating element assembled with feed cables, in accordance with some disclosed embodiments.

FIG. 7 illustrates radiating element 100 including a feeding cable 18 that provides electrical power to radiating element 100. Feeding cable 18 includes an outer conductor 13 and an inner conductor 14. Feeding cable 18 is electrically connected to radiating units 1*a*-1*d* via an electrical connecting element, such as electrical connecting element 19 in FIG. 2. Electrical connecting element 19 may be disposed lower than the upper surfaces of radiating units 1*a*-1*d*, as shown in FIG. 2. Such configuration may improve impedance characterization of the radiating element 100.

Electrical connecting element 19 may comprise one or more feeding slices 5, as shown in FIG. 1, to electrically connect feeding cable 18 to one or more half-wave dipoles, respectively. Referring to FIG. 2, radiating units 1*a* and 1*c* are connected to inner 14 and outer 13 conductors of feeding cable 18, respectively, to form a first dipole. Similarly, radiating units 1*b* and 1*d* are connected to inner 14 and outer 13 conductors of another feeding cable 18, respectively, to form a second dipole that is orthogonal to the first dipole. To connect radiating unit 1*a* to inner conductor 14 of feed cable 18, feeding slice 5, which may be a conductive piece that includes first and second ends, can be used. For example, referring to FIGS. 1 and 2, the first end of feeding slice 5 may be mounted and/or welded to a mounting structure 7 formed on radiating unit 1*a* to electrically connect radiating unit 1*a* to feeding slice 5. Radiating unit 1*a* may thereby constitute a first arm of the half-wave dipole. Radiating unit 1*c*, which may constitute a second arm of the half-wave dipole, includes a cylindrical connecting structure (structure 16 in FIG. 3) formed thereon. The cylindrical connecting structure 16 includes a through-hole 8, through which inner conductor 14 of feed cable 18 is connected to the second end of feeding slice 5, thereby connecting radiating unit 1*a* to inner conductor 14. Outer conductor 13 of feeding cable 18 is connected (e.g., welded) to cylindrical connecting structure 16, thereby connecting outer conductor 13 to radiating unit 1*c*. Electrical insulation is applied between the second end of feeding slice 5 and cylindrical connecting structure 16. For example, an insulation gasket 6 may be disposed between feeding slice 5 and cylindrical connecting structure 16. In some embodiments, insulation gasket 6 may also be disposed between feeding slice 5 and mounting structure 7. Insulation gasket 6 may be made from an insulating material such as plastic, ceramic, etc. A second feeding slice 5 may be configured in a similar manner to connect a second feed cable 18 to a second half-wave dipole that includes radiating units 1*b* and 1*d*, as shown in FIGS. 1 and 2. The two feeding slices can be orthogonal to each other, as shown in FIG. 2, and electrically insulated. As shown in FIG. 2, the feeding slices are configured in the center opening of the radiating element 100 and below the upper surfaces of radiating units 1*a*-1*d*.

Supporting element 10, loading element 9, and radiating units 1*a*-1*d* may be integrally formed by die-casting, which may simplify manufacturing, assembling, and welding, to achieve high consistency with low cost.

Figure 8:
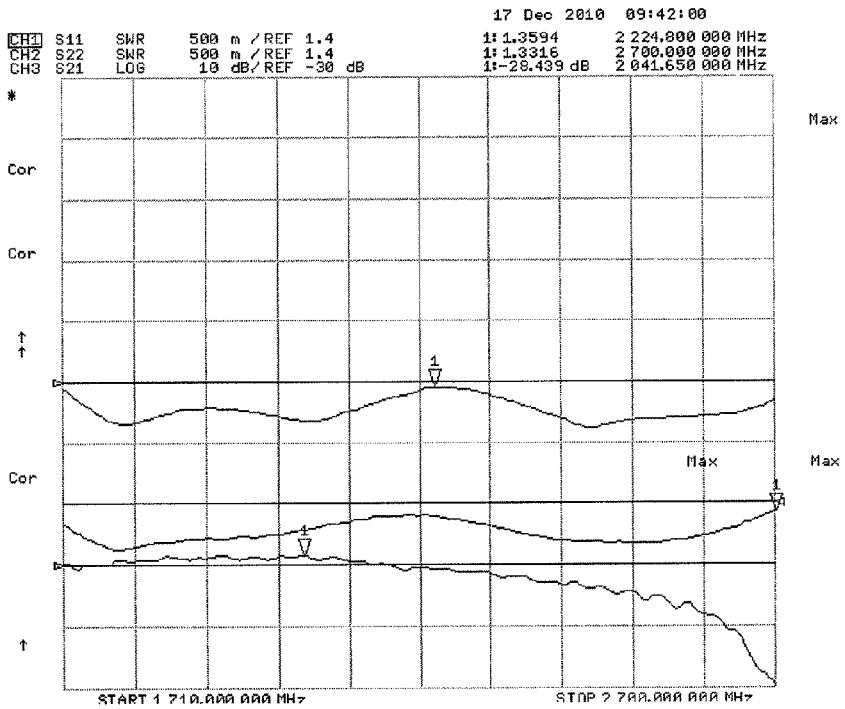
FIG. 8 is a graph showing VSWR ("Voltage Standing Wave Ratio") and isolation performance of an exemplary radiating element consistent with some disclosed embodiments.

FIG. 8 is a graph showing VSWR ("Voltage Standing Wave Ratio") and isolation performance of the exemplary radiating element shown in FIG. 3. For example, FIG. 8 shows that the exemplary radiation element operates within 17102700 MHz frequency band, VSWR is less than 1.4, and isolation is less than −28 dB. In FIG. 8, three curves are shown, corresponding to testing results obtained from three input channels (testing ports CH1 to CH3 shown on the upper left corner of FIG. 8) of a Vector Network Analyzer. On each curve, a triangular mark with a number 1 indicates the maximum value of that curve. The upper curve shows standing wave ratio (SWR) of channel 1 (S11), with the maximum value about 1.3594 at frequency about 2224.8 MHz. The middle curve shows SWR of channel 2 (S22), with the maximum value about 1.3316 at frequency about 2700 MHz. The lower curve shows isolation between channel 1 and channel 2, with the maximum value about −28.439 dB at frequency about 2041.65 MHz.

Figure 9:
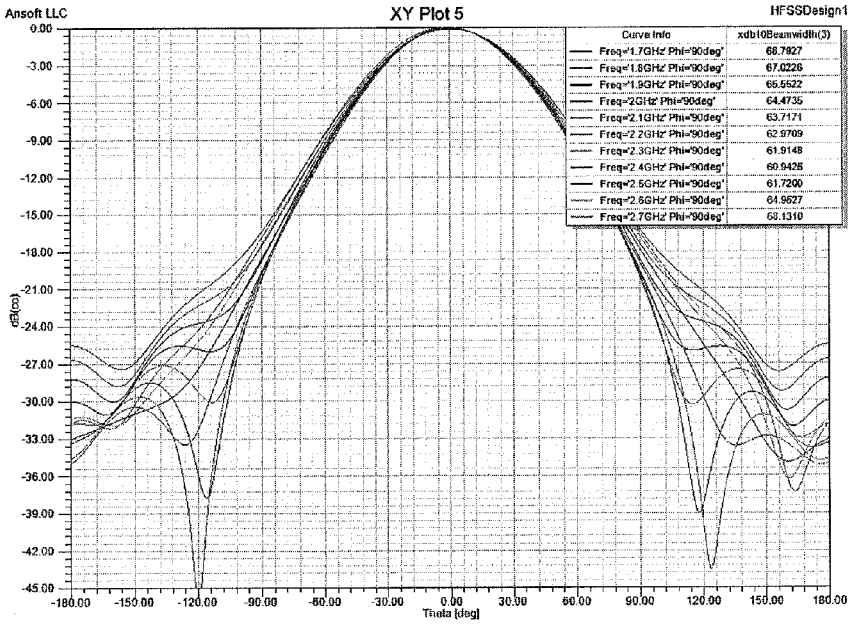
FIG. 9 is a graph showing radiation pattern of an exemplary radiating element consistent with some disclosed embodiments.

FIG. 9 is a graph showing horizontal radiation pattern of the exemplary radiating element shown in FIG. 3. In FIG. 9, the upper right portion lists half power beam width (HPBW) values for different frequencies. It can be seen that at operating frequency band from about 1710 to about 2700 MHz, the beamwidth of the exemplary radiating element is from about 61 degrees to about 69 degrees.

FIG. 10 illustrates an exemplary antenna 200 including a reflector 201 and radiating element 100. As shown in FIG. 10, reflector 201 includes assembling brackets 202 to mount radiating element 100 onto reflector 201 to form antenna 200. Antenna 200 equipped with radiating element 100 and reflector 201 is configured to generate wideband dual-polarized directional radiation. A distance between the upper surface of radiating element 100 and reflector 201 may be about 0.2 to 0.3 wavelength corresponding to a central operating frequency. For example, if the central operating frequency is 2200 MHz, then the distance between the upper surface of radiating element 100 and reflector 201 may be about 27 mm to 41 mm.

The exemplary radiating elements disclosed above utilize a direct feeding method for feeding power to half-wave dipoles. This direct feeding method has advantages such as reliability and flexibility. However, it is noted that other feeding methods, such as air coupling feeding method, may also be used to implement the radiating element.

In the foregoing descriptions, various aspects or components are grouped together in a single embodiment for purposes of illustrations. The disclosure is not to be interpreted as requiring all of the disclosed variations for the claimed subject matter.

Moreover, it will be apparent to those skilled in the art from consideration of the specification and practice of the present disclosure that various modifications and variations can be made to the disclosed radiating element and antenna without departing from the scope of the disclosure, as claimed. Thus, it is intended that the specification and examples be considered as exemplary only, with a true scope of the present disclosure being indicated by the following claims and their equivalents.

What is claimed is:

1. A radiating element comprising:

a supporting element; and a plurality of radiating units formed at one end of the supporting element, wherein each of the radiating units has a lower surface facing towards the supporting element and an upper surface facing away from the supporting element;

wherein the radiating element further comprises:

a first and second dividing pieces symmetrically disposed on each of the radiating units, wherein the first dividing piece and a first portion of outer edges of the radiating unit form a first polygonal hollowed space, and the first portion of outer edges of the radiating unit includes a first right angle tip of the radiating unit; the second dividing piece and a second portion of outer edges of the radiating unit form a second polygonal hollowed space, and the second portion of outer edges of the radiating unit includes a second right angle tip of the radiating unit; the first and second dividing pieces and a third portion of outer edges of the radiating unit form a third polygonal hollowed space, and the third portion of outer edges of the radiating unit includes a third right angle tip of the radiating unit; wherein the first and second polygonal hollowed spaces are symmetrical with respect to the third polygonal hollowed space; wherein the first and second dividing pieces of the plurality of radiating units are substantially within a same plane;

a loading element formed on the lower surface of each of the plurality of radiating units, wherein the loading element includes first and second pieces each extending outward from the supporting element and along an edge of the radiating unit, and wherein the first and second pieces are substantially perpendicular to each other; and an electrical connecting element for connecting the radiating units to a feeding cable, the electrical connecting element being lower than the upper surfaces of the radiating units.

2. The radiating element of claim 1, wherein the loading element has a rectangular-shaped cross section along an extending direction.

3. The radiating element of claim 1, wherein the loading element has a triangular-shaped cross section along an extending direction.

4. The radiating element of claim 1, wherein the loading element has a trapezoidal-shaped cross section along an extending direction.

5. The radiating element of claim 1, wherein the radiating units have substantially equal height; and adjacent ones of the radiating units are substantially equally spaced.

6. The radiating element of claim 1, comprising four radiating units arranged symmetrically in a two-by-two matrix configuration, wherein each two diagonally arranged radiating units form a half-wave dipole; wherein the four radiating units form two half-wave dipoles that are orthogonally arranged to generate radiation with ±45 degrees polarization.

7. The radiating element of claim 6, wherein each of the four radiating units is square-shaped with a depressed portion at an inner corner; and the depressed portions of the four radiating units form an opening in a center portion of the two-by-two matrix configuration.

8. The radiating element of claim 6, wherein the electrical connecting element comprises a feeding slice for electrically connecting the feeding cable to one of the two half-wave dipoles, wherein:

the feeding slice comprises first and second ends;

the first end is electrically connected to a first one of the radiating units of the half-wave dipole via a mounting structure;

the second end is electrically connectable to an inner conductor of the feeding cable;

a second one of the radiating units of the half-wave dipole is electrically connectable to an outer conductor of the feeding cable via a through-hole; and the second end and the second radiating unit are electrically insulated.

9. The radiating element of claim 8, further comprising an insulation gasket disposed between the feed slice and the second radiating unit.

10. The radiating element of claim 1, wherein the supporting element, the loading element, and the radiating units are integrally formed by die-casting.

11. An antenna comprising a reflector and the radiating element of claim 1.

12. The antenna of claim 11, wherein the supporting element of the radiating element comprises an aligning pin and a screw hole for mounting the radiating element onto the reflector.

13. The antenna of claim 11, wherein a distant between the upper surfaces of the radiating units and the reflector is about 0.2 to 0.3 wavelength corresponding to a central operating frequency.

* * * * *

UNITED STATES PATENT AND TRADEMARK OFFICE

CERTIFICATE OF CORRECTION

PATENT NO. : 9,196,969 B2
APPLICATION NO. : 13/419140
DATED : November 24, 2015
INVENTOR(S) : Zhonglin Wu et al.

It is certified that error appears in the above-identified patent and that said Letters Patent is hereby corrected as shown below:

In the claims,

Claim 13, Col. 8, Line 13, "wherein a distant between" should read as --wherein a distance between--.

Signed and Sealed this
Twenty-second Day of March, 2016

Michelle K. Lee

Michelle K. Lee
*Director of the United States Patent and Trademark Office*